US008684494B2

(12) United States Patent
Ficarra et al.

(10) Patent No.: US 8,684,494 B2
(45) Date of Patent: Apr. 1, 2014

(54) FLUID APPLICATOR FOR A PRINTHEAD FACE

(75) Inventors: Richard P. Ficarra, Williamson, NY (US); Christine Ann Steurrys, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/555,301

(22) Filed: Jul. 23, 2012

(65) Prior Publication Data

US 2014/0022301 A1 Jan. 23, 2014

(51) Int. Cl.
*B41J 2/165* (2006.01)

(52) U.S. Cl.
USPC ..... 347/28

(58) Field of Classification Search
USPC ..... 347/28, 45
See application file for complete search history.

(56) References Cited

U.S. PATENT DOCUMENTS 1,656,338 A * 1/1928 Ranger ..... 358/3.29
4,368,476 A * 1/1983 Uehara et al. ..... 347/45
5,005,024 A * 4/1991 Takahashi et al. ..... 347/45
5,905,514 A * 5/1999 Rhoads et al. ..... 347/33
6,102,518 A * 8/2000 Taylor ..... 347/29
6,416,161 B1 * 7/2002 Berg et al. ..... 347/33
6,913,338 B2 7/2005 Rhoads et al.
7,111,917 B2 9/2006 Hill et al.
7,311,378 B2 12/2007 Fujimori et al.
RE40,294 E 5/2008 Rhoads et al.
7,556,342 B2 7/2009 Hamano
8,091,980 B2 1/2012 Snyder et al.
2005/0146545 A1 7/2005 Richards
2005/0146572 A1 7/2005 Hill et al.
2006/0268050 A1 11/2006 Sonobe
2007/0126783 A1 6/2007 Deshon-Stepp et al.
2007/0146460 A1 * 6/2007 Gordon et al. ..... 347/103
2011/0189918 A1 8/2011 Zhao et al.

* cited by examiner

*Primary Examiner* — Matthew Luu
*Assistant Examiner* — Alexander D Shenderov
(74) *Attorney, Agent, or Firm* — Maginot, Moore & Beck, LLP

(57) ABSTRACT

An apparatus applies release agent to a printhead face to prevent ink from wetting the surface of the printhead face. The release agent is applied by an applicator that is coupled to a release agent supply by a wicking member. The applicator can be integrated into a wiper for the printhead to enable release agent application and printhead facing wiping to occur at approximately the same time.

18 Claims, 3 Drawing Sheets

FLUID APPLICATOR FOR A PRINTHEAD FACE

TECHNICAL FIELD

This disclosure relates generally to inkjet printers and, in particular, to inkjet printers having automated cleaning systems.

BACKGROUND

In general, inkjet printers include at least one printhead that ejects drops of liquid ink directly onto recording media or onto a surface of an intermediate image receiving member for transfer to recording media. The intermediate image receiving member in an indirect inkjet printer can be a rotating metal drum or endless belt. In a direct printer, the recording media can be in sheet or continuous web form. A phase change inkjet printer employs phase change inks that are solid at ambient temperature, but transition to a liquid phase at an elevated temperature. Once the melted ink is ejected onto recording media or the surface of an intermediate image receiving member, the ink droplets quickly solidify to form an ink image.

Printers typically conduct various maintenance operations to ensure proper operation of the inkjets in each printhead. One known maintenance operation removes particles or other contaminants that may interfere with printing operations from each printhead in a printer. During such a cleaning maintenance operation, the printheads purge ink through some or all of the inkjets in the printhead. The purged ink flows from the apertures of the inkjets that are located in a faceplate of each printhead onto the faceplate. The ink rolls downwardly under the effect of gravity to an ink drip bib mounted at the lower edge of the faceplate or onto a flexure chute mounted on a maintenance station. The drip bib or flexure chute is configured to collect the liquid ink and direct the ink into an ink receptacle. In some printers, one or more wipers are manipulated to contact the faceplate of each printhead and wipe the purged ink toward the drip bib to facilitate the collection and removal of the purged ink.

Some of the purged ink may remain on the printhead. Other sources of ink on the printhead include ink that may drool from inkjets during printing of certain frequencies or ink that may drip from other components. Inkjet printheads are typically coated with a hydrophobic material to maintain a low surface energy on the printhead face to enable ink on a printhead to run off the printhead face. However, over time the hydrophobic coating on the printheads wears off and the surface energy of the printhead face increases. The increased surface energy can result in ink adhering to the printhead during printing and maintenance operations and can reduce the pressure at which ink flows from the inkjets onto the printhead and can cause inkjets in the printhead to malfunction or clog, potentially resulting in print defects. Thus, improved surface coating of printheads is desirable.

SUMMARY

An apparatus for applying release agent to a printhead face has been developed. The apparatus comprises an applicator mounted to a support member, a container configured to store a volume of release agent, a wicking member, and an actuator. The wicking member has a first end and a second end, the first end being submerged in the volume of release agent within the container and the second end being fluidly connected to the applicator to deliver release agent by capillary action from the container to the applicator. The actuator is operatively connected to the support member and configured to move the support member to contact a printhead face with the applicator to apply release agent to the printhead face as the applicator moves past the printhead face.

In another embodiment a method of applying a fluid to a printhead face has been developed. The method comprises submerging a first end of a wicking member in release agent stored in a container, delivering the release agent by capillary action to an applicator that is operatively connected to a second end of the wicking member and that is mounted on a support member, and operating an actuator operatively connected to the support member to contact and apply release agent to a printhead face with the applicator.

In a yet another embodiment a printer that applies release agent to a printhead has been developed. The printer includes a printhead having a plurality of inkjet ejectors that eject ink through a plurality of apertures in a printhead face, an applicator mounted on a support member, a container configured to store a volume of release agent, a wicking member, and an actuator. The wicking member has a first end and a second end, the first end being submerged in the release agent in the container and the second end being fluidly connected to the applicator to enable the wicking member to deliver release agent by capillary action from the container to the applicator. The actuator is operatively connected to the support member and configured to move the support member to contact the printhead face with the applicator to apply release agent to the printhead face as the applicator moves past the printhead face.

DETAILED DESCRIPTION

Figure 1:
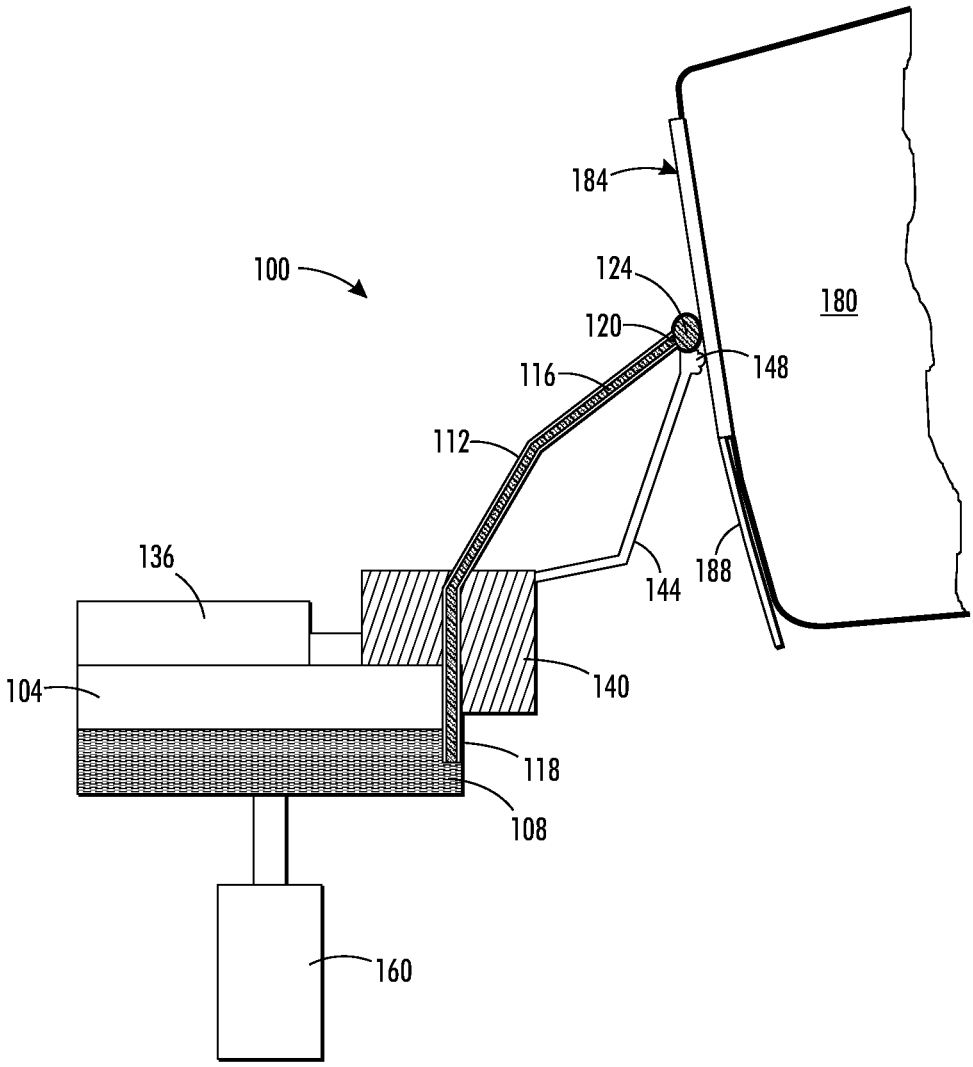
FIG. 1 is a side view of a printhead maintenance station.

For a general understanding of the present embodiments, reference is made to the drawings. In the drawings, like reference numerals have been used throughout to designate like elements. As used herein, the terms "printer," "printing device" or "imaging device" generally refer to a device that produces an image with one or more colorants on print media and may encompass any such apparatus, such as a digital copier, bookmaking machine, facsimile machine, multi-function machine, etc. which generates printed images for any purpose.

The term "printhead" as used herein refers to a component in the printer that is configured with inkjet ejectors to eject ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on an image receiving surface. Some printer embodiments include a plurality of printheads arranged in a print zone. An image receiving surface, such as a print medium or the surface of an intermediate member that carries an ink image, moves past the printheads in a process direction through the print zone. The inkjets in the printheads eject ink drops in rows in a cross-process direction, which is perpendicular to the process direction across the image receiving surface.

Phase change ink printers use phase change ink, also referred to as a solid ink, which has a solid state at room temperature but melts into a liquid at a higher operating temperature. The liquid ink drops are printed onto an image receiving member or a media sheet. As described in more detail below, both direct and indirect printers apply a coating of release agent to selected components in the printer to prevent phase change ink from adhering to the printer components instead of the print medium.

Figure 2:
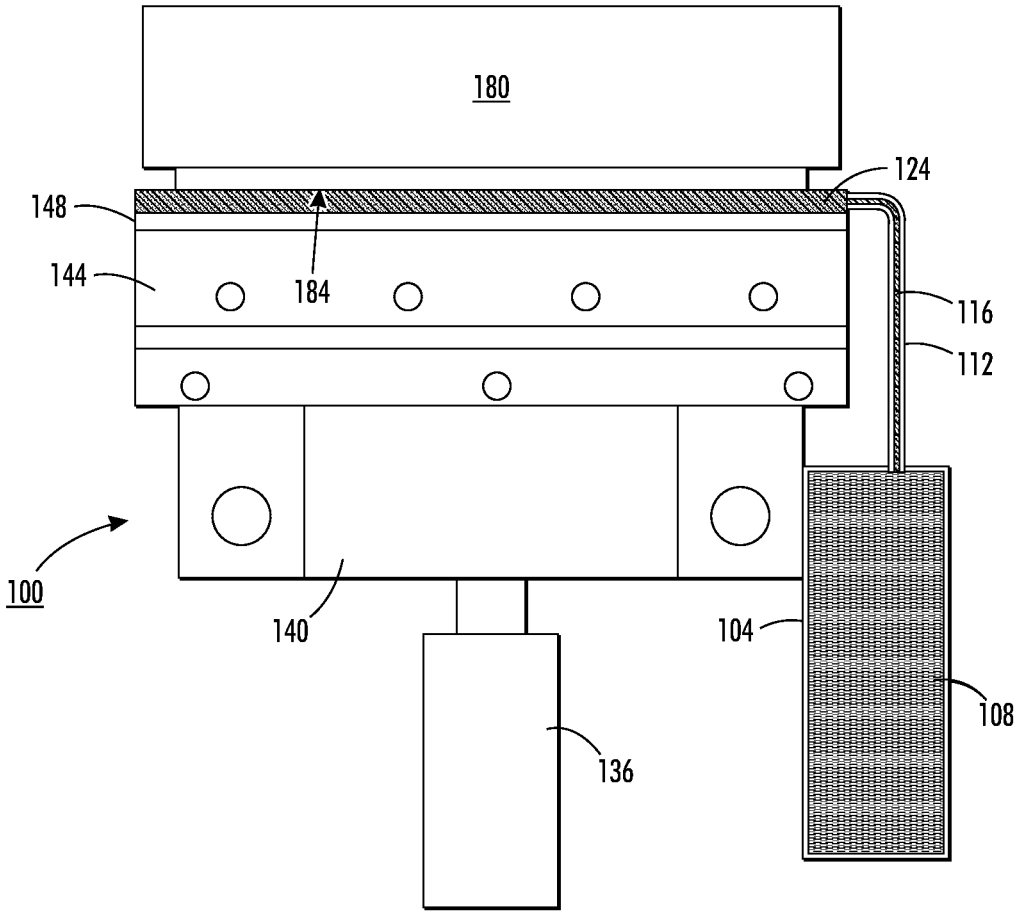
FIG. 2 is a top view of the printhead maintenance station of FIG. 1.

FIG. 1 and FIG. 2 illustrate a maintenance station 100 for a printhead 180. The maintenance station 100 includes a wiper mount 140, a support member 144, an actuator 136, a release agent container 104, a wicking member 116, and a release agent applicator 124. The release agent container 104 is mounted to the wiper mount 140 and is configured to hold a volume of release agent 108. In one practical embodiment the release agent is silicone oil, although other suitable release agents can be used in other embodiments. The release agent container 104 can be open to air, or the container 104 can be closed to prevent the container from spilling the release agent 108 during transport of the maintenance station 100. In one embodiment the release agent container 104 is sized to store enough release agent for the expected life of the printer in which the maintenance station 100 is installed. In other embodiments the release agent container can be configured to be refilled during the life of the printer.

The wicking member 116 includes a first end 118 and a second end 120. The first end 118 is submerged in the volume of release agent 108 inside the release agent container 104 while the second end 120 is operatively connected to the release agent applicator 124. The wicking member 116 is formed of a porous material to enable the wicking member 116 to deliver release agent by capillary action from the container 104 to the release agent applicator 124. In one embodiment the wicking member is made of wool, though in other embodiments polypropylene, cotton, fiberglass, or any other suitable material can be used. The wicking member 116 is surrounded by a plastic tube 112, which prevents release agent from dripping from the wicking member 116 onto other components in the printer or maintenance station 100. The tube 112 can be formed of rigid plastic material to enable the tube 112 to retain the wicking member 116 in a fixed position between the first end 118 and the second end 120, or the tube can be formed of flexible plastic material to enable the tube and wicking member to move in relation to the container and applicator. In other embodiments, the flexible tube can be formed of rubber, latex, steel, or another suitable material.

The release agent applicator 124 is mounted above the support member 144 in the embodiment of FIG. 1, and, as shown in FIG. 2, is configured to extend across a length of a face 184 on the printhead 180. The release agent applicator 124 is configured to contact the printhead face 184 to apply release agent 108 to the printhead face 184 as the maintenance station 100 wipes the printhead face 184. The release agent applicator 124 is formed of a porous material to enable the release agent 108 to wet the entire applicator 124 evenly. In one embodiment the release agent applicator 124 and wicking member 116 are formed of a single piece of material, although in other embodiments the applicator and wicking member can be formed of different materials or two or more distinct pieces of the same material.

The support member 144 includes a wiper 148 on a first end of the support member 144 configured to contact the printhead face 184 to wipe a plurality of apertures in the printhead face 184. In the embodiment of FIG. 1, the wiper 148 is positioned directly below the release agent applicator 124 to enable the release agent applicator 124 to follow the wiper 148 as the wiper 148 wipes downwardly on the printhead face 184. On a second end, the support member 144 is fixedly connected to and configured to move with the wiper mount 140.

The actuator 136 is operatively connected to the wiper mount 140 and is configured to move the wiper mount 140 toward and away from the printhead 180. The support member 144, wiper 148, container 104, tube 112, wicking member 116, and release agent applicator 124 move in response to the wiper mount 140 moving to enable the wiper 148 and applicator 124 to move into contact with the printhead face 184. The actuator 136 can be any suitable linear or rotational actuator, for example, an electric stepping motor or a pneumatic piston.

In operation, the printer in which the maintenance station 100 is installed initiates a maintenance cycle. The printhead 180 docks with the maintenance station 100 and the printhead begins a purge by applying a low pressure to an ink reservoir that is fluidly coupled to the inkjet ejectors. This low pressure causes the ejectors to release ink at low pressure onto the printhead face 184. The majority of the purged ink flows down the printhead face 184, onto a drip bib 188, and into an ink receptacle (not shown). In other embodiments a flexure chute mounted to the maintenance station is used in place of a drip bib to direct the purged ink into the ink receptacle. The flexure chute is configured to contact a lower portion of the printhead face to channel the purged ink into an ink receptacle mounted to the maintenance station. The maintenance station 100 is configured to wipe the remaining ink off the printhead face 184 with the wiper 148 and apply release agent with the applicator 124 as the maintenance station 100 wipes the printhead face 184.

To wipe the remaining ink off the printhead face 184, the actuator 136 extends to push the wiper mount 140, support member 144, wiper 148, release agent container 104, tube 112, wicking member 116, and release agent applicator 124 toward the printhead face 148 until the wiper 148 and applicator 124 contact a top portion of the printhead face 184. The actuator 136 can retract and extend a plurality of times to dab the printhead face 184 with the wiper 148 to heat the wiper 148 to a predetermined temperature and enable the wiper 148 to wipe the printhead face 184 without ink solidifying on the wiper 148.

The maintenance station 100 is then translated downwardly by a second actuator 160 while the wiper 148 is in contact with the printhead face 184 to wipe the printhead face 184 with the wiper 148 and release agent applicator 124. As the maintenance station 100 moves downwardly, the wiper 148 urges any ink remaining on the printhead face 184 toward the drip bib 188, or in other embodiments, flexure chute, and into the ink receptacle. The release agent applicator 124 follows the wiper 148 and applies a thin coating of release agent to the printhead face 124 to ensure that the surface energy on the printhead face 184 remains low, reducing the likelihood of ink flowing from inkjets when the inkjets are not printing or excess ink drooling from the inkjets during printing. Furthermore, application of the release agent to the printhead face 184 reduces abrasion on the printhead face 184 from subsequently wiping the printhead 180.

Figure 3:
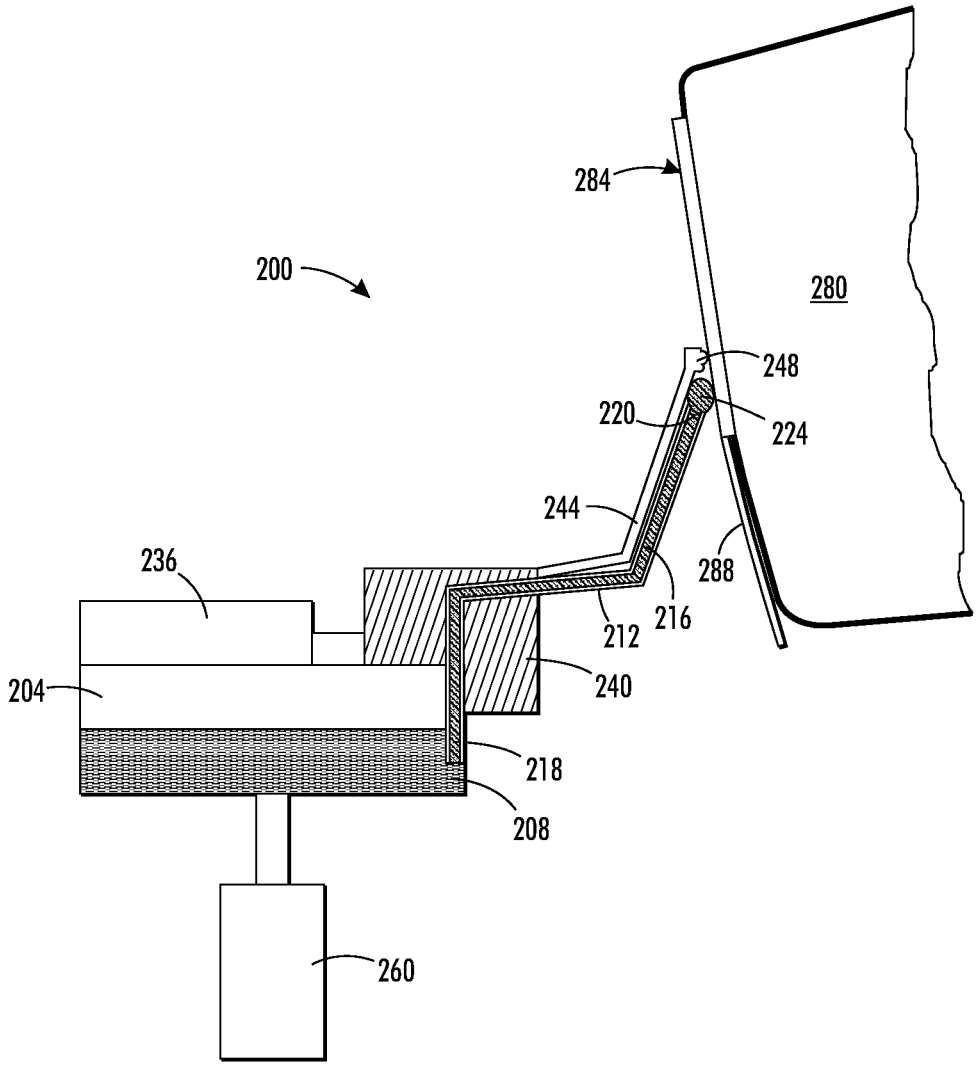
FIG. 3 is a side view of another printhead maintenance station.

FIG. 3 depicts another embodiment of a maintenance station 200 for a printhead 280. The maintenance station 200 includes a wiper mount 240, a support member 244, an actuator 236, a release agent container 204, a wicking member 216, and a release agent applicator 224. The release agent container 204 is fixedly mounted to the wiper mount 240 and is configured to hold a volume of release agent 208, which, in one embodiment, is silicone oil. The release agent container 204 can be open to air, or the container 204 can be closed to prevent the container from spilling the release agent 208 during transport of the maintenance station 200.

The wicking member 216 includes a first end 218 and a second end 220. The first end 218 is submerged in the volume of release agent 208 inside the release agent container 204 while the second end is operatively connected to the release agent applicator 224. The wicking member 216 is formed of a porous material to enable the wicking member 216 to deliver release agent by capillary action from the release agent container 204 to the release agent applicator 224. The wicking member 216 is surrounded by a plastic tube 212, which prevents the release agent from dripping from the wicking member 216 onto other components in the printer or maintenance station 200.

The release agent applicator 224 is mounted below the support member 244 in the embodiment of FIG. 3, and is configured to extend across a length of the printhead face 284. The release agent applicator 224 is configured to contact the face 284 of the printhead 280 to apply release agent 208 to the printhead face 284 as the maintenance station 200 wipes the printhead face 284. The release agent applicator 224 is formed of a porous material to enable the release agent 208 to wet the entire applicator 224 evenly.

The support member 244 includes a wiper 248 on a first end of the support member 244 that is configured to contact the printhead face 284 to wipe a plurality of apertures in the printhead face 284 containing inkjet ejectors. In the embodiment of FIG. 3, the wiper 248 is positioned directly above the release agent applicator 224 to enable the wiper 248 to follow the release agent applicator 224 as the applicator 224 and wiper 248 wipe downwardly on the printhead face 284. On a second end, the support member 244 is fixedly connected to and configured to move with the wiper mount 240.

The actuator 236 is operatively connected to the wiper mount and is configured to move the wiper mount 240 toward and away from the printhead 280. The support member 244, wiper 248, container 204, tube 212, wicking member 216, and release agent applicator 224 move in response to the wiper mount 240 moving to enable the wiper 248 and applicator 224 to move into contact with the printhead face 284. The actuator 236 can be any suitable linear or rotational actuator, for example, an electric stepping motor or a pneumatic piston.

In operation, the printer in which the maintenance station 200 is installed initiates a maintenance cycle. The printhead 280 docks with the maintenance station 200 and begins a purge, activating the inkjet ejectors in the printhead face 284 to release ink at a low pressure. The majority of the purged ink flows down the printhead face 284, onto a drip bib 288, and into an ink receptacle (not shown). Ink remaining on the printhead face 284 after the purge is wiped off the face by the maintenance station 200.

To wipe the remaining ink off the printhead face 284, the actuator 236 extends to push the wiper mount 240, support member 244, wiper 248, release agent container 204, tube 212, wicking member 216, and release agent applicator 224 toward the printhead face 284 until the wiper 248 and applicator 224 contact a top portion of the printhead face 284. The actuator 236 can retract and extend a plurality of times to dab the printhead face 284 with the wiper 248 to heat the wiper 248 to a predetermined temperature and enable the wiper 248 to wipe the printhead face 284 without ink solidifying on the wiper 248.

The maintenance station 200 is then translated downwardly by a second actuator 260 while the wiper 248 is in contact with the printhead face 284 to wipe the printhead face 284 with the wiper 248 and release agent applicator 224. As the maintenance station 200 moves downwardly, the applicator 224 applies release agent to the printhead face 284. The wiper 248 follows the applicator 224, urging any ink remaining on the printhead face 284 toward the drip bib 288 and into the ink receptacle, while also spreading the release agent across the printhead face 284. The thin coating of release agent left on the printhead face 284 ensures that the surface energy on the printhead face 284 remains low, reducing the likelihood of ink flowing from inkjets when the inkjets are not printing or excess ink drooling from the inkjets during printing. Furthermore, the release agent reduces wear on the printhead face 284 caused by contact with the wiper 248.

It will be appreciated that variations of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. An apparatus for applying a fluid to a printhead face comprising:

a support member having a first end and a second end;

a wiper mount to which the first end of the support member is mounted;

a wiper mounted to the second end of the support member;

a container configured to store a volume of release agent;

an applicator positioned adjacent to the wiper;

a wicking member having a first end and a second end, the first end being submerged in the volume of release agent within the container and the second end being fluidly connected to the applicator to deliver release agent by capillary action from the container to the applicator, the wicking member being operatively connected to the wiper mount;

a first actuator operatively connected to the wiper mount and configured to move the wiper mount to move the applicator and the wiper into contact with a printhead face to enable the applicator to apply release agent to the printhead face and the wiper to wipe the printhead face; and a second actuator operatively connected to the wiper mount to move the wiper and the applicator parallel to the printhead face to enable the wiper to wipe the printhead face as the applicator applies release agent to the printhead face.

2. The apparatus of claim 1 further comprising:

a tube surrounding the wicking member between the first end and the second end to enable release agent to remain in the wicking member as the release agent is delivered to the applicator.

3. The apparatus of claim 2 wherein the tube is substantially comprised of plastic.

4. The apparatus of claim 1 wherein the release agent substantially comprises silicone oil.

5. The apparatus of claim 1, the fluid applicator having a length substantially equal to a length across the printhead face in a cross-process direction.

6. The apparatus of claim 1 wherein the wiper is positioned below the applicator to enable the applicator to apply release agent to a portion on the printhead face subsequent to the wiper wiping the portion on the printhead face.

7. The apparatus of claim 1 wherein the wiper is positioned above the applicator to enable the wiper to distribute release agent across the printhead face subsequent to the applicator applying release agent to the printhead face.

8. The apparatus of claim 1 wherein the fluid applicator and the wicking member are formed of a single piece of material.

9. A method of applying a fluid to a printhead face comprising:

submerging a first end of a wicking member in release agent stored in a container;

delivering the release agent by capillary action to an applicator that is operatively connected to a second end of the wicking member and that is operatively connected to a wiper mount;

positioning a wiper adjacent the applicator, the wiper being mounted to a second end of a support member extending from the wiper mount;

operating a first actuator operatively connected to the wiper mount to move the applicator and the wiper into contact with a printhead face; and operating a second actuator to move the applicator and the wiper to wipe the printhead face as the applicator applies release agent to the printhead face.

10. The method of claim 9 wherein the release agent substantially comprises silicone oil.

11. The method of claim 9, the positioning of the wiper further comprising:

positioning the wiper adjacent to and below the applicator to enable operation of the second actuator to apply release agent with the applicator to a portion of the printhead face subsequent to the wiper wiping the portion of the printhead face.

12. The method of claim 9, the positioning of the wiper further comprising:

positioning the wiper adjacent to and above the applicator to enable operation of the actuator to distribute with the wiper release agent applied by the applicator to the printhead face.

13. A printer comprising:

a printhead having a plurality of inkjet ejectors that eject ink through a plurality of apertures in a printhead face;

a support member having a first end and a second end;

a wiper mount to which the first end of the support member is mounted;

a wiper mounted to the second end of the support member;

an applicator positioned adjacent the wiper;

a container configured to store a volume of release agent;

a wicking member having a first end and a second end, the first end being submerged in the release agent in the container and the second end being fluidly connected to the applicator to enable the wicking member to deliver release agent by capillary action from the container to the applicator, the wicking member being operatively connected to the wiper mount;

a first actuator operatively connected to the wiper mount and configured to move the wiper mount to move the applicator and the wiper into contact with the printhead face to enable the applicator to apply release agent to the printhead face and the wiper to wipe the printhead face; and a second actuator operatively connected to the wiper mount to move the wiper and the applicator parallel to the printhead face to enable the wiper to wipe the printhead face as the applicator applies release agent to the printhead face.

14. The printer of claim 13 further comprising:

a tube surrounding the wicking member between the first end and the second end to enable the release agent to remain in the wicking member as the release agent is delivered to the applicator.

15. The printer of claim 14 wherein the tube is substantially comprised of plastic.

16. The printer of claim 13 wherein the release agent substantially comprises silicone oil.

17. The printer of claim 13, the fluid applicator having a length substantially equal to a length of the printhead face in the cross-process direction.

18. The printer of claim 13 wherein the applicator and the wicking member are formed of a single piece of material.

* * * * *